US008297737B2

(12) United States Patent
Lin et al.

(10) Patent No.: US 8,297,737 B2
(45) Date of Patent: Oct. 30, 2012

(54) INKJET HEAD

(75) Inventors: Wuu-Jyi Lin, Taipei Hsien (TW); Chen-Hsing Cheng, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 305 days.

(21) Appl. No.: 12/784,641

(22) Filed: May 21, 2010

(65) Prior Publication Data

US 2011/0012959 A1 Jan. 20, 2011

(30) Foreign Application Priority Data

Jul. 14, 2009 (CN) ..... 2009 1 0157567

(51) Int. Cl.
*B41J 2/135* (2006.01)

(52) U.S. Cl. ..... 347/44; 347/68

(58) Field of Classification Search ..... 347/40, 347/44, 49–50, 58, 64–65, 68, 71, 87
See application file for complete search history.

(56) References Cited

U.S. PATENT DOCUMENTS 6,550,691 B2 * 4/2003 Pence ..... 239/102.2
7,520,595 B2 * 4/2009 Lu et al. ..... 347/69

* cited by examiner

*Primary Examiner* — Thinh Nguyen
(74) *Attorney, Agent, or Firm* — Altis Law Group, Inc.

(57) ABSTRACT

An inkjet head includes a main body, a film, a piezoelectric atomizer, a cover and a nozzle plate. The main body includes a cavity receiving a fluid with an opening connecting the cavity. The cover is fastened to a top end of the main body. The film is interposed between the cover and the main body. The nozzle plate includes a plurality of nozzles. The nozzle plate is disposed on a bottom end of the main body. The piezoelectric atomizer is interposed between the cover and the film. The piezoelectric atomizer introduces pressure variations in a static pressure to atomize the fluid.

10 Claims, 7 Drawing Sheets

INKJET HEAD

BACKGROUND

1. Technical Field

The disclosure generally relates to printers, and particularly to an inkjet head with a piezoelectric atomizer.

2. Description of Related Art

Some inkjet devices of the continuous stream type generally employ an inkjet head having a droplet generator with multiple nozzles from which continuous streams of ink droplets are emitted and directed to a recording medium or a collection gutter. Generally speaking, it is critical for all jet streams in a multiple jet printer to have the droplets break off in a forward merge or no satellite condition if high quality printing and a reliable printing system are to be achieved.

What is needed, therefore, is an inkjet head addressing the limitations described.

DETAILED DESCRIPTION OF THE EMBODIMENTS

Figure 1:
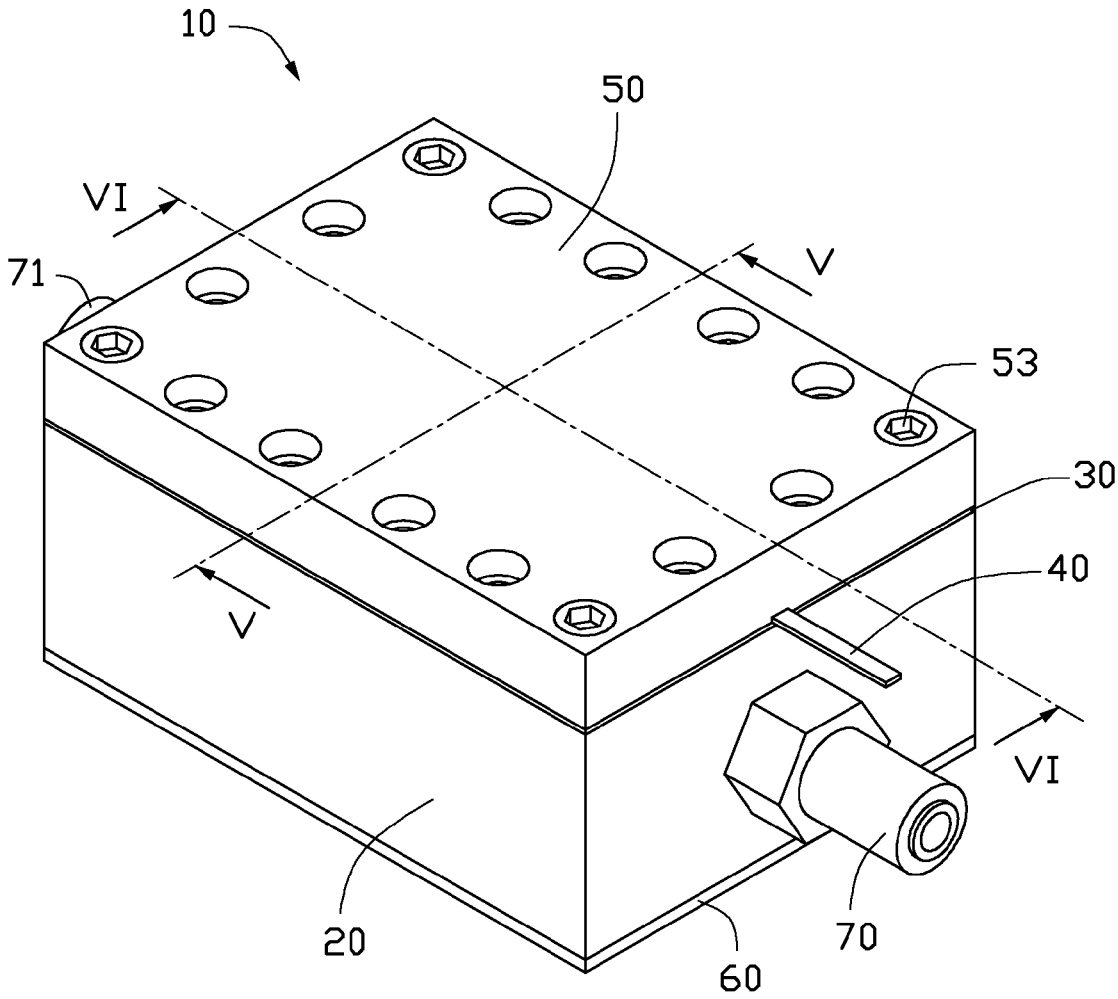
FIG. 1 is a perspective view of first embodiment of an inkjet head.
Figure 2:
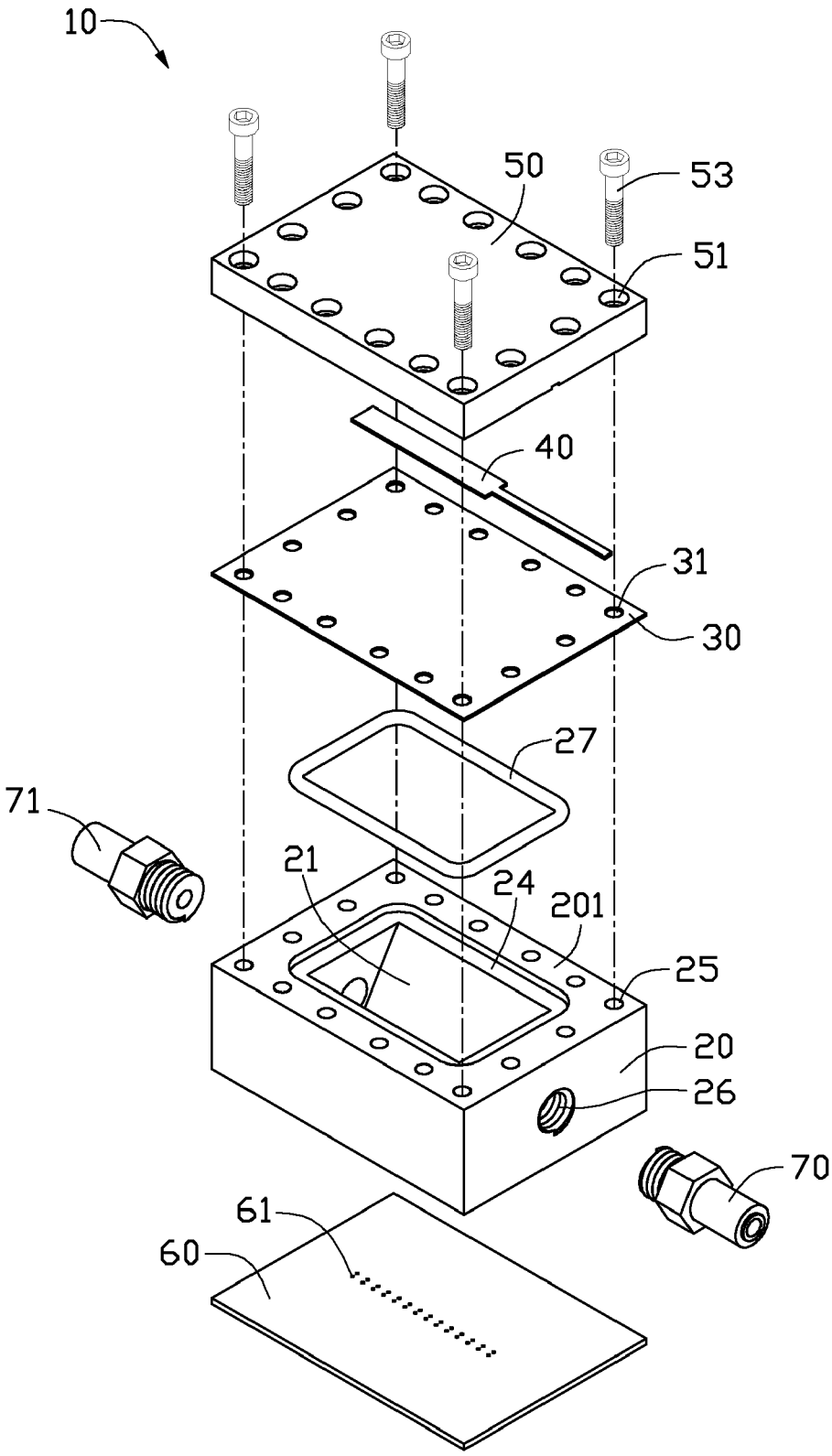
FIG. 2 is an exploded perspective view of the inkjet head of FIG. 1.
Figure 3:
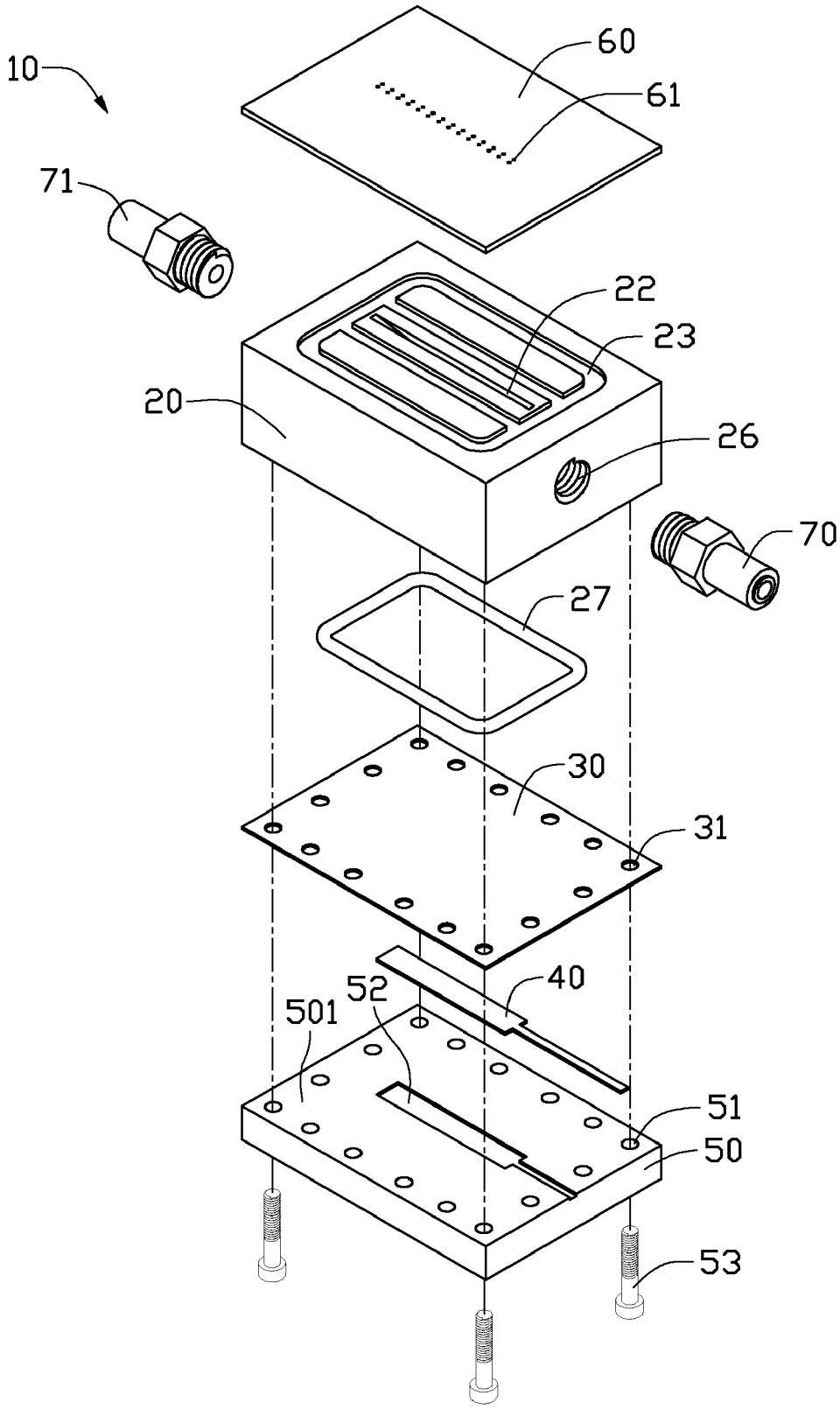
FIG. 3 is another exploded perspective view of the inkjet head of FIG. 1.

Referring to FIGS. 1-3, a first embodiment of an inkjet head 10 includes a main body 20, a film 30, a piezoelectric atomizer 40, a cover 50 and a nozzle plate 60.

A resonant fluid cavity 21 is defined in the main body 20. The cavity 21 can be triangular. A plurality of fixing holes 25 and a groove 24 are defined in a top end 201 of the main body 20. An opening 22 and a slot 23 are defined in a bottom end of the main body 20. The groove 24 and the opening 22 are connected with the cavity 21. A threaded hole 26 is defined in two side ends of the main body 20 communicating with the cavity 21.

A plurality of through holes 31 are defined in the film 30. The film 30 may be made of a soft material such as polytetrafluoroethylene.

The piezoelectric atomizer 40 may be made of piezoelectric material.

A plurality of stepped holes 51 are defined in the cover 50. A notch 52 is defined in a bottom end 501 of the cover 50 for receiving the piezoelectric atomizer 40.

A plurality of nozzles 61 is defined in the nozzle plate 60.

Figure 4:
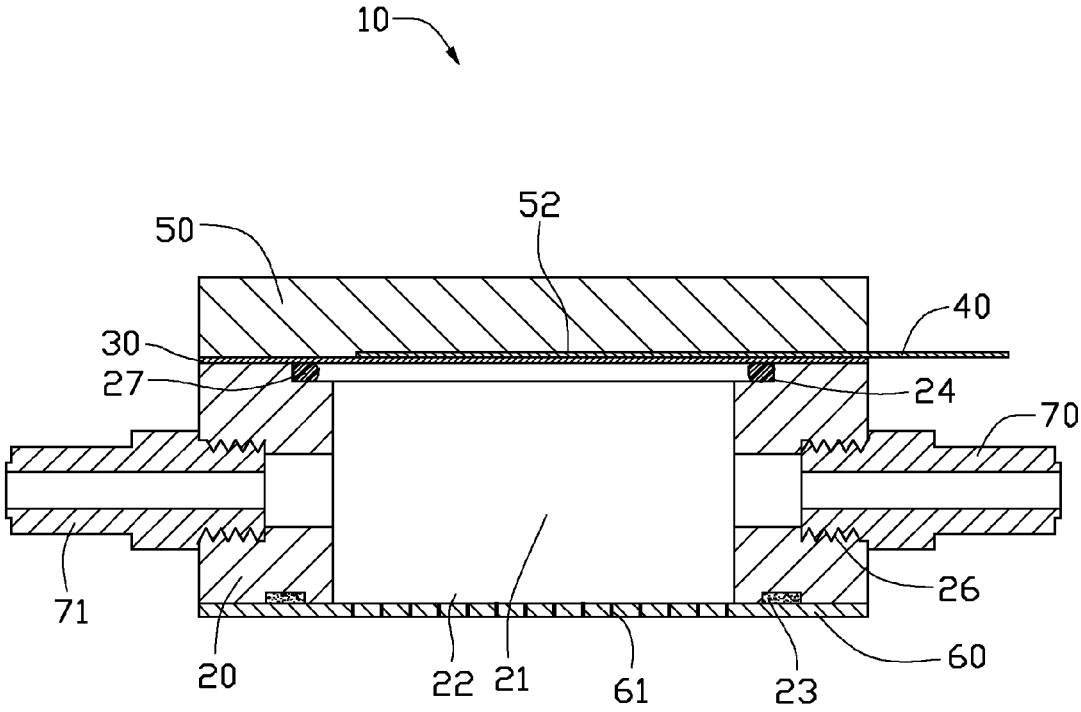
FIG. 4 is a cross section taken along plane IV-IV of the inkjet head of FIG. 1.
Figure 5:
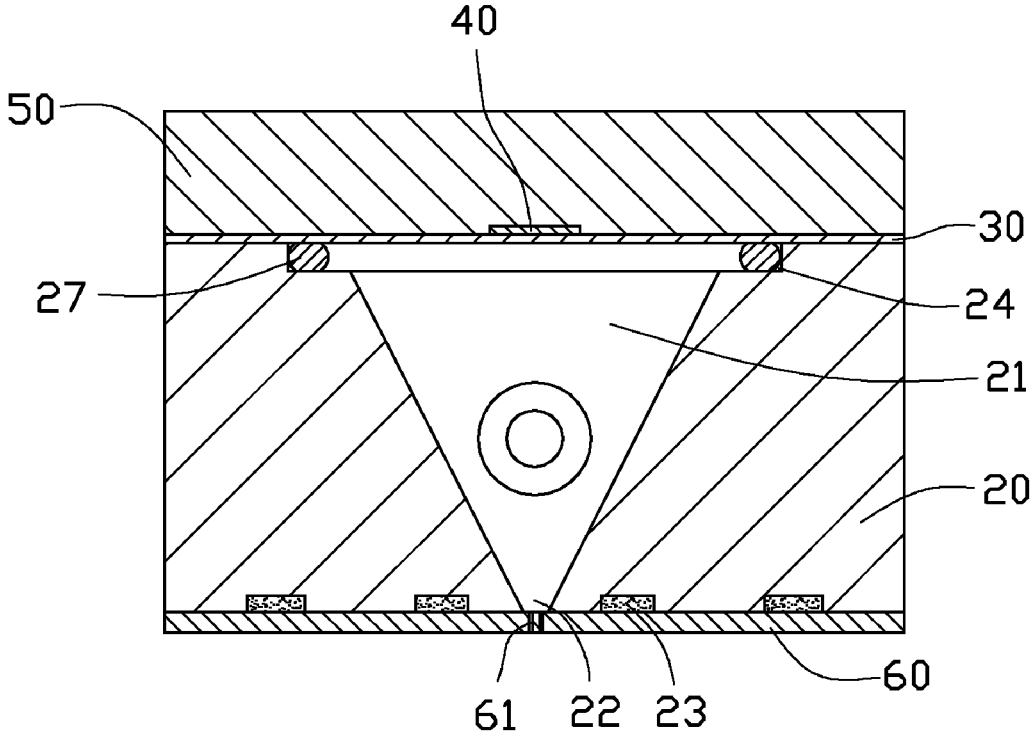
FIG. 5 is a cross section taken along plane V-V of the inkjet head of FIG. 1.

Referring also to FIGS. 4 and 5, in assembly, a ring 27 is mounted in the groove 24 of the main body 20. The piezoelectric atomizer 40 is received in the notch 52 of the cover 50, and a conductive material is interposed between the piezoelectric atomizer 40 and the cover 50. The film 30 is attached on the bottom end 501 of the cover 50 to cover the piezoelectric atomizer 40. The cover 50 is mounted on the main body 20. A plurality of fasteners 53 enter the fixing holes 25 on the main body 20 after passing through corresponding stepped holes 51 of the cover 50 and through holes 31 of the film 30. The nozzle plate 60 is disposed on the bottom end of the main body 20. An adhesive is interposed between the nozzle plate 60 and the slot 23 of the main body 20.

Two suitable fluid connectors 70, 71 are received in the two threaded holes 26 of the main body 20. A fluid is fed under static pressure into the cavity 21 of the main body 20 by the connector 70. Air in the cavity 21 of the main body 20 is exhausted by the connector 71 until the cavity 21 fills with fluid. The piezoelectric atomizer 40 introduces pressure variations to a static pressure at the nozzle 61 of the nozzle plate 60, and the fluid is atomized and printed on a workpiece.

Figure 6:
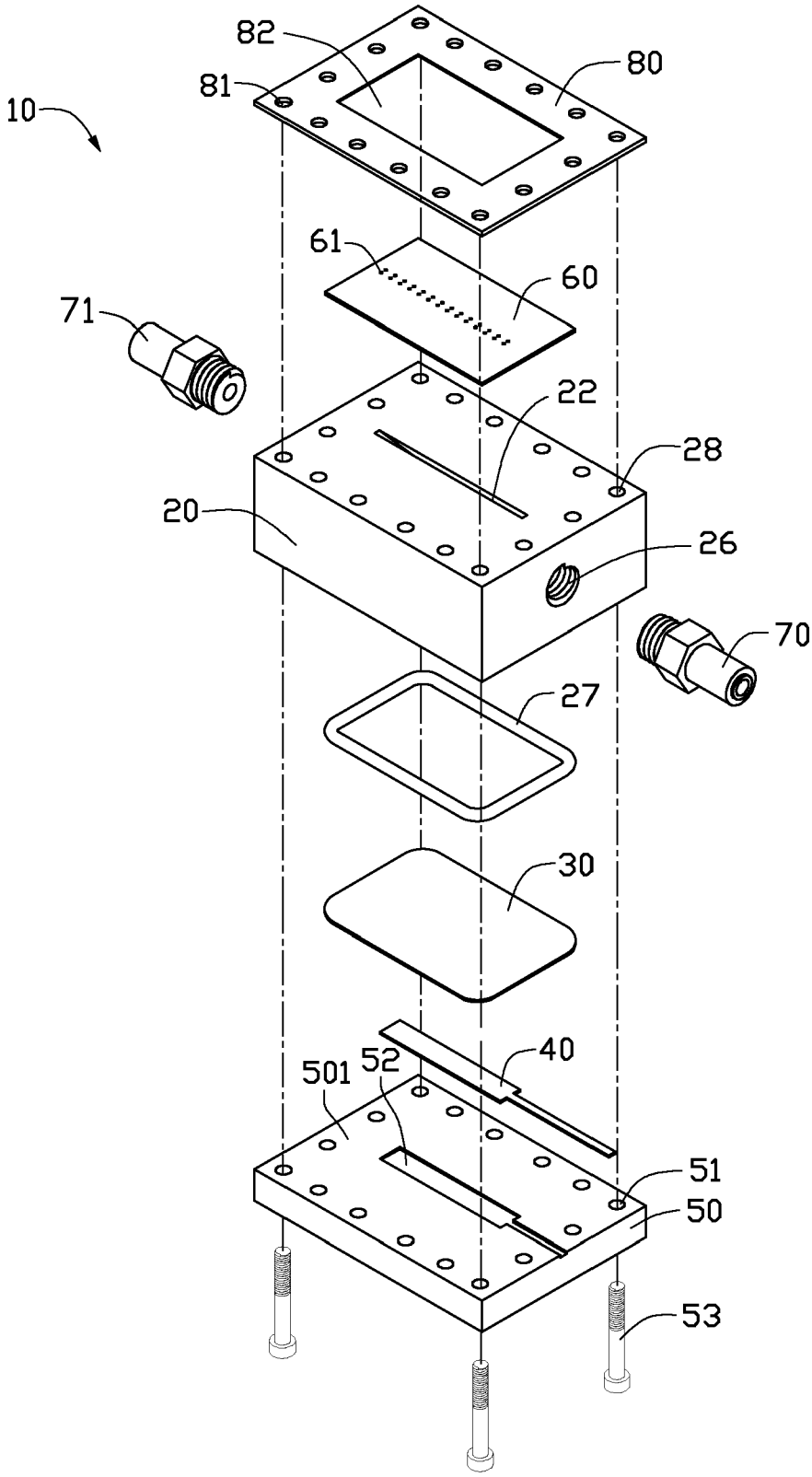
FIG. 6 is a perspective view of a second embodiment of an inkjet head.
Figure 7:
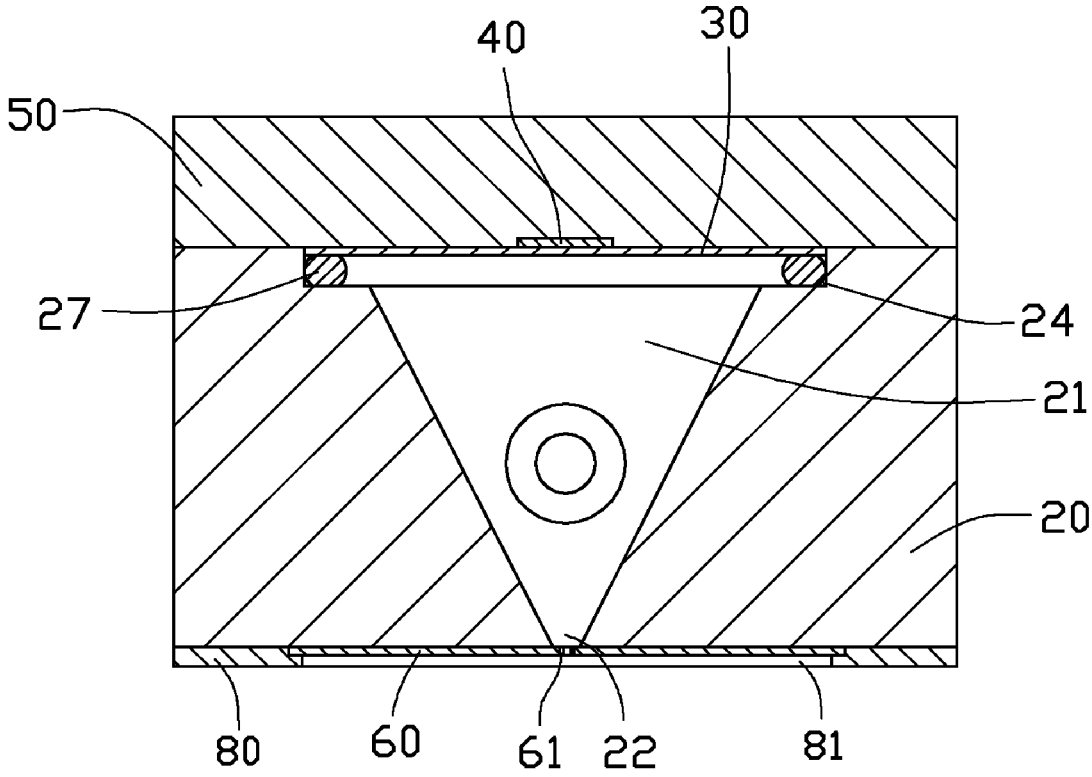
FIG. 7 is a sectional view of the inkjet head of FIG. 6.

FIG. 6 and FIG. 7 illustrate an inkjet head 10 of a second embodiment of the disclosure, differing from the first embodiment only in that inkjet head 10 further includes a fixing plate 80 disposed on the bottom end of the main body 20. A plurality of through holes 28 is defined in the main body 20. A plurality of fixing holes 81 and an opening 82 are defined in the fixing plate 80. A plurality of fasteners 53 enters the fixing holes 81 on the fixing plate 80 after passing through corresponding stepped holes 51 on the cover 50 and through holes 28 on the main body 20.

It is to be understood, however, that even though numerous characteristics and advantages of various embodiments have been set forth in the foregoing description, together with details of the structures and functions of the embodiments, the disclosure is illustrative only; and that changes may be made in detail, especially in matters of arrangement of parts within the principles of the invention to the full extent indicated by the broad general meaning of the terms in which the appended claims are expressed.

What is claimed is:

1. An inkjet head comprising:

a main body comprising a cavity for receiving a fluid, a top end, and an opening connecting the cavity;

a cover fastened to the top end of the main body;

a film interposed between the cover and the main body;

a nozzle plate comprising a plurality of nozzles, the nozzle plate disposed on a bottom end of the main body;

two connectors; and a piezoelectric atomizer interposed between the cover and the film, the piezoelectric atomizer introducing pressure variations to a static pressure to atomize the fluid, wherein a threaded hole is defined in two side ends of the main body communicating with the cavity, and the two connectors are received in the two threaded holes of the main body.

2. The inkjet head as claimed in claim 1, wherein the cavity is triangular.

3. The inkjet head as claimed in claim 2, further comprising a ring, wherein a groove is defined in the top end of the main body, in which the ring is mounted.

4. The inkjet head as claimed in claim 1, wherein the piezoelectric atomizer is a piezoelectric material.

5. The inkjet head as claimed in claim 1, wherein the film is a soft material.

6. The Inkjet head as claimed in claim 5, wherein the soft material is polytetrafluoroethylene.

7. The inkjet head as claimed in claim 1, wherein a plurality of stepped holes is defined in the cover, a plurality of through holes is defined in the film, a plurality of fixing holes and a groove are defined in a top end of the main body, and a plurality of fasteners enters the fixing holes of the main body after passing through corresponding stepped holes of the cover and through holes of the film.

8. The inkjet head as claimed in claim 1, further comprising a fixing plate disposed on the bottom end of the main body, wherein a plurality of stepped holes is defined in the cover, a plurality of through holes is defined in a top end of the main body, a plurality of fixing holes is defined in the fixing plate, a plurality of fasteners enters the fixing holes of the fixing plate after passing through corresponding stepped holes of the cover and through holes of the main body.

9. An inkjet head comprising:

a main body comprising a cavity for receiving a fluid, a top end, and an opening connecting the cavity;

a cover fastened to the top end of the main body;

a film interposed between the cover and the main body;

a nozzle plate comprising a plurality of nozzles, the nozzle plate disposed on a bottom end of the main body;

a piezoelectric atomizer interposed between the cover and the film, the piezoelectric atomizer introducing pressure variations to a static pressure to atomize the fluid; and an adhesive, wherein a slot is defined in the bottom end of the main body, and the adhesive is interposed between the nozzle plate and the slot of the main body.

10. An inkjet head comprising:

a main body comprising a cavity for receiving a fluid, a top end, and an opening connecting the cavity;

a cover fastened to the top end of the main body;

a film interposed between the cover and the main body;

a nozzle plate comprising a plurality of nozzles, the nozzle plate disposed on a bottom end of the main body; and a piezoelectric atomizer interposed between the cover and the film, the piezoelectric atomizer introducing pressure variations to a static pressure to atomize the fluid, wherein a notch is defined in the bottom end of the cover, and the piezoelectric atomizer is received in the notch.

* * * * *